United States Patent [19]

Rhoades

[11] Patent Number: 4,512,174

[45] Date of Patent: Apr. 23, 1985

[54] COMBINED SHEET BENDING BRAKE AND PLATFORM

[75] Inventor: James J. Rhoades, Garden City, Mich.

[73] Assignee: Tapco Products Company, Inc., Detroit, Mich.

[21] Appl. No.: 385,461

[22] Filed: Jun. 7, 1982

[51] Int. Cl.[3] ..... B21D 5/04

[52] U.S. Cl. ..... 72/319; 248/646

[58] Field of Search ..... 72/319–323, 72/293; 269/56, 289 R, 91; 248/670, 676, 646, 237; 312/25, 29, 122, 350

[56] References Cited

U.S. PATENT DOCUMENTS

| | | | |
|---|---|---|---|
| 274,398 | 3/1883 | Snowden | 72/321 |
| 404,164 | 5/1889 | Buckman | 72/319 |
| 480,396 | 8/1892 | Clark | 72/319 |
| 486,435 | 11/1892 | Conde | 312/29 |
| 575,602 | 1/1897 | Gramelspacher | 312/25 |
| 886,000 | 4/1908 | Hudson | 312/25 |
| 2,225,762 | 12/1940 | Barnsteiner | 312/350 |
| 2,230,511 | 2/1941 | Luttrup | 248/676 |
| 2,401,031 | 5/1946 | Wanasek | 72/319 |
| 2,591,656 | 4/1952 | Getgey | 248/646 |
| 2,905,224 | 9/1959 | Allison | 72/319 |
| 3,147,791 | 9/1964 | Rauen et al. | 72/319 |
| 3,482,427 | 12/1969 | Barnack | 72/319 |
| 4,081,986 | 4/1978 | Break | 72/320 |
| 4,237,716 | 12/1980 | Onisko | 72/319 |

FOREIGN PATENT DOCUMENTS

| | | | |
|---|---|---|---|
| 348118 | 3/1921 | Fed. Rep. of Germany | 248/646 |

OTHER PUBLICATIONS

"New Brake for Metal Worker," from *Metal Worker,* Oct. 8, 1887, p. 28.

*Primary Examiner*—Daniel C. Crane

*Attorney, Agent, or Firm*—Barnes, Kisselle, Raisch, Choate, Whittemore & Hulbert

[57] ABSTRACT

A combined sheet bending brake and platform comprising a base, first and second bending members hinged to one another, an anvil member for clamping a work piece of sheet material on the first member such that moving the second member relative to the first member will bend the sheet material and a platform extending longitudinally for at least a portion of the length of the sheet bending brakes along the base generally parallel and opposite to the hinge axis of the two members such that the area overlying the brake is generally unobstructed.

14 Claims, 4 Drawing Figures

COMBINED SHEET BENDING BRAKE AND PLATFORM

This invention relates to sheet bending brakes and particularly to portable sheet bending brakes.

BACKGROUND AND SUMMARY OF THE INVENTION

In the handling of sheet material such as is used for building construction, it has been common in recent times to provide a portable sheet bending brake wherein sheet material is clamped between an anvil member and a clamping surface and a bending member is hinged for bending the sheet material about the anvil member. Typical sheet bending brakes are disclosed in U.S. Pat. Nos. 3,161,223, 3,481,174, 3,482,427, 3,559,444, 3,817,075 and 4,240,279.

As shown, for example, in the aforementioned U.S. Pat. Nos. 3,161,223, 3,559,444, 3,817,075 and 4,240,279, the anvil member is clamped into position by means of a backing plate that has inclined cams underlying a portion of the fixed frame so that when the plate is moved longitudinally by a hand lever, the cams are moved into and out of position clamping and unclamping the backing plate.

In the aforementioned U.S. Pat. Nos. 3,481,174 and 3,482,427, the anvil is supported by pivoted bars that, in turn, are connected by links to a handle that is pivoted on the frame of the brake so that rotation of the handle moves the bars and, in turn, the anvil into and out of clamping position.

It has also heretofore been suggested that eccentric cams be utilized for moving the anvil member into and out of positions as shown, for example, in the U.S. Pat. Nos. 3,383,899, 4,092,841 and 4,081,986.

In the use of such brakes, it is often necessary to place a piece of sheet material aside while working on another piece. Accordingly, an objective of the present invention is to provide a combined sheet bending brake and platform which will support a piece of sheet material without interfering with the operation of the brake.

In accordance with the invention, the combined sheet bending brake and platform comprising a base, first and second bending members hinged to one another, an anvil member for clamping a work piece of sheet material on the first members such that moving the second member relative to the one member will bend the sheet material and a platform extending longitudinally for at least a portion of the length of the sheet bending brakes along the base generally parallel and opposite to the hinge axis of the two members such that the area overlying the brake is generally unobstructed.

DESCRIPTION

Figure 1:
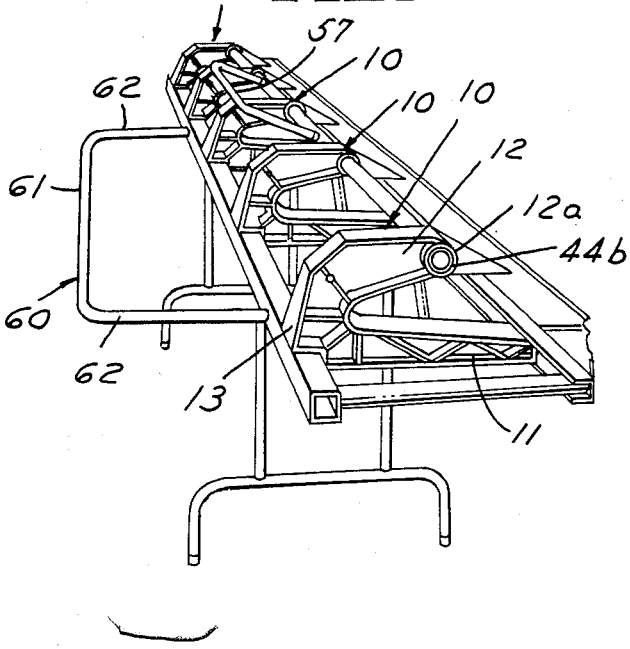
FIG. 1 is a perspective view of a sheet bending brake embodying the invention.
Figure 3:
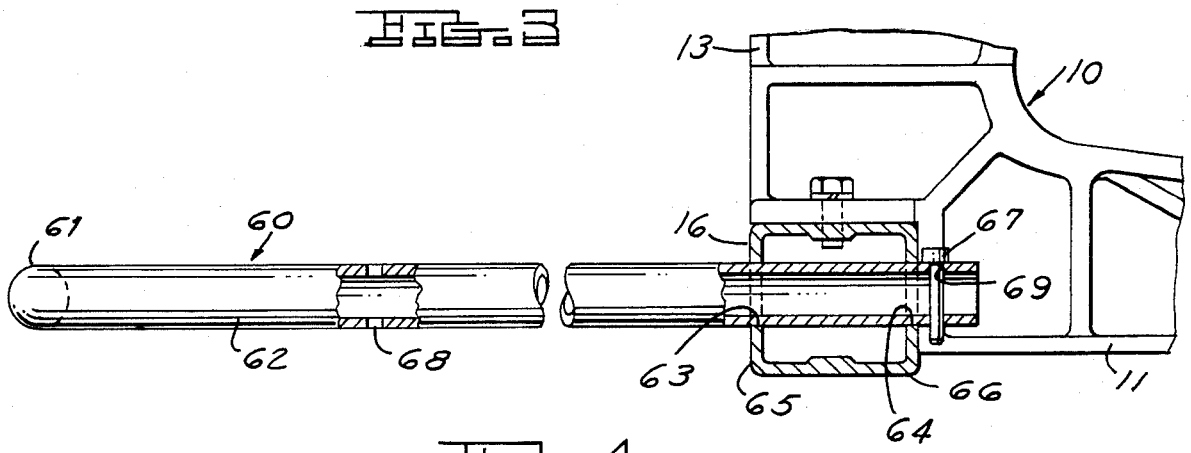
FIG. 3 is a fragmentary sectional view taken along the line 3—3 in FIG. 2.
Figure 2:
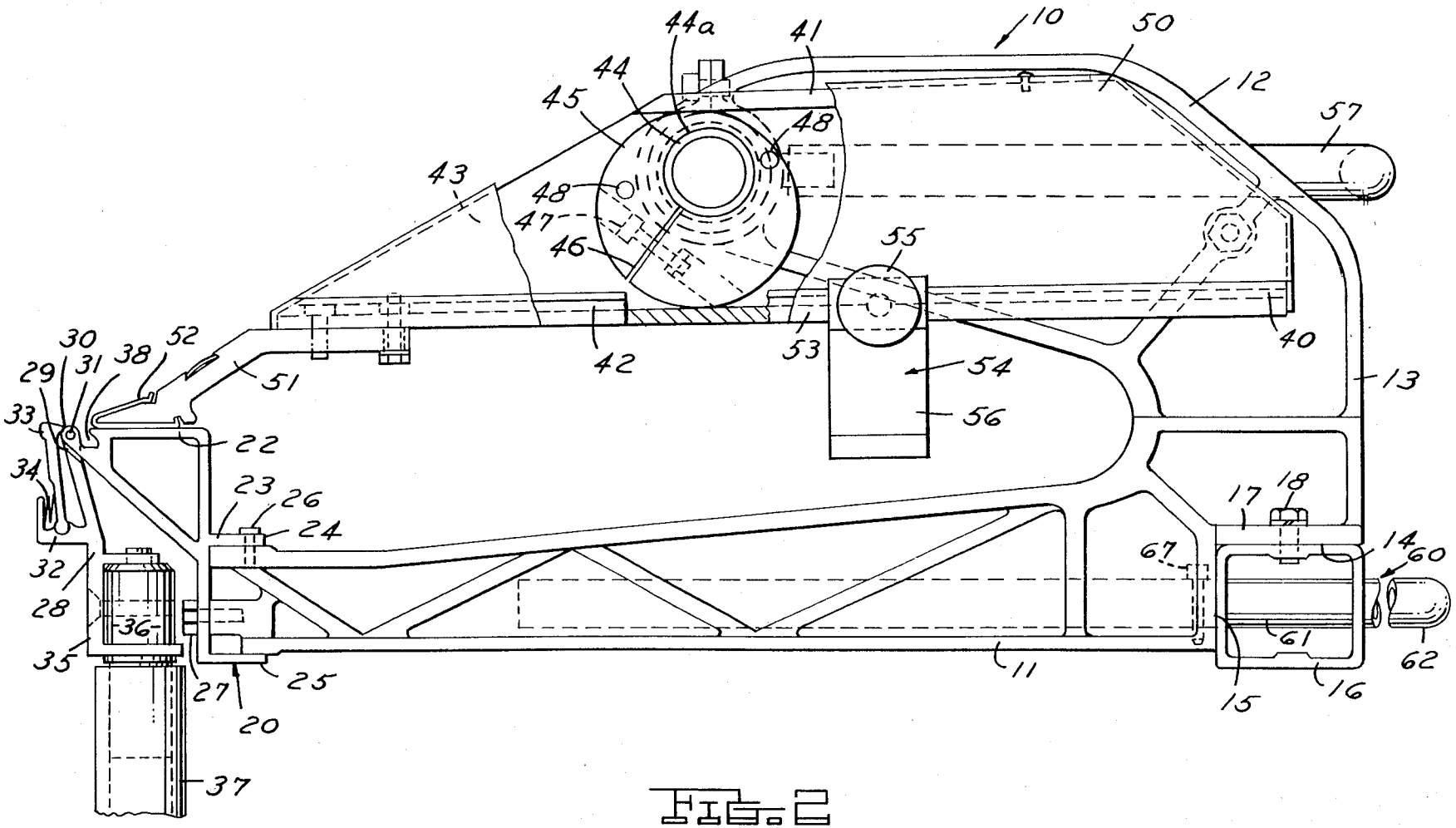
FIG. 2 is a fragmentary side-elevational view on an enlarged scale.

Referring to FIGS. 1 and 3, the sheet bending brake comprises a plurality of longitudinally spaced C-shaped frame members 10 which are preferably injection molded of reinforced plastic such as 30% glass filled nylon. Each frame member 10 includes a lower arm 11 and an upper arm 12 with a connecting portion 13, the upper arm 12 being shorter than the lower arm 11. Each frame member 10 includes a rearwardly extending recess or notch defined by a horizontal surface 14 and a vertical surface 15 for receiving an extruded aluminum square rear rail 16. As shown in FIG. 2, portion 13 includes laterally extending flanges 17 overlying the upper surface of the rear rail 16 through which screws 18 extend to fasten the rear rail to the frame members.

A first fixed extruded aluminum member 20 is provided on the front end of the lower arms 11 as presently described and comprises an upper generally triangular portion defining a horizontal clamping surface 22 and a lower C-shaped portion 23 that has upper and lower walls 24, 25 that telescope over the free ends of the lower arms 11. Screws 26, 27 extend through openings in the upper wall 24 and vertical portion of the C-shaped portion 23 into the arm 11 to fasten the fixed member 20 on the arms 11.

An extruded aluminum bending member 28 is hinged to a portion of the fixed member 20 by a hinge defined by intermeshing projections 29, 30 on the member 28, 20, respectively. A hinge pin 31 extends through aligned openings in the projections 29, 30 to complete the hinge. The bending member 28 further includes a laterally extending L-shaped portion 32 that receives the lower end of an extruded floating member 33 yieldingly urged by a spring 34 against the hinge. The member 33 engages the sheet to be bent and minimizes marring during the bending as more fully described in U.S. Pat. Nos. 3,481,174 and 3,482,427 which are incorporated herein by reference. The fixed member 28 further includes a C-shaped portion 35 that supports an adaptor 36 for receiving a tubular handle 37.

A fixed member 20 includes a downwardly open recess 38 for receiving the bent portions of a previously bent sheet to bend two portions of the sheet further toward one another.

The sheet bending brake further includes a plurality of extruded aluminum bars 40, a bar 40 being pivoted to each frame member 10 by a bolt 40*a* at the area of juncture of the rear of the arm 12 and the upper part of the connecting portion 13. Each bar 40 includes an upper flange 41, a lower flange 42, and a vertical wall 43. An aluminum shaft 44 is journalled in the forward ends of the upper arms 12 by plastic bearings 44*a* and extend through enlarged openings in the vertical walls of bars 40. A plurality of plastic eccentric cams 45 are fixed on shaft 44 so that they are positioned between the upper and lower flanges 41, 42 of each bar. Each frame member 10 has axially extending bosses 12*a* surrounding the opening through which shaft 44 extends (FIG. 1). A collar 44*b* holds shaft 44 axially against boss 12.

Each cam 45 is split radially as at 46 and a bolt 47 and nut 48 clamps cam to the shaft 44. By loosening the bolt and nut, the position of the cam 45 can be adjusted on the shaft 44. Openings 48 are provided on the sides of cam 45 for receiving a spanner wrench to facilitate adjustment.

The open side of each bar 40 is closed to cover the cam by a protective plastic cover 50 that has the configuration of arm 40.

The bars 40 support an anvil member 51 that includes an upper horizontal portion bolted to the flange of the bars 40, an inclined portion and a V-shaped nose portion having a horizontal bottom surface and an inclined upper surface. As shown in FIG. 1, a protective strip 52 of sheet metal such as rolled stainless steel is provided.

The sheet bending brake further includes an adjustable stop 53 that is formed by an extruded portion defining a track on the lower flange 42 of each bar 40 that receives a complementary C-shaped portion 54 on a stop 53 so that the stop 53 can be moved along the track and held in position by a thumb screw 55. The stop includes a downwardly extending portion 56 that is adapted to engate the rear edge of a sheet that is moved between the arms to provide a stop for adjusting the sheet in proper position for bending.

A handle 57 is provided for totating the shaft 44 to rotate cams 45 to move anvil member 51 into and out of clamping relation to surface 22. The handle 57 comprises a U-shaped tube including a central portion and legs that are telescoped over radial projections on spaced collars fixed on shaft 44 (FIG. 1). The collars 5 are split and adjustably clamped on shaft 44 so their position can be adjusted. The handle 57 is adjusted so that it extends horizontally when the anvil 51 is in clamping position and is moved forwardly toward the operator and an upright position to move the anvil out of clamping position.

The sheet bending brake heretofore described is substantially like that shown and claimed in U.S. patent application Ser. No. 359,566, filed Mar. 18, 1982, now U.S. Pat. No. 4,489,583, having a common assignee with the present application and the structure thereof is incorporated herein by reference.

Figure 4:
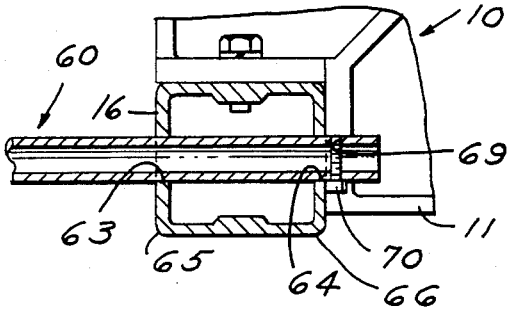
FIG. 4 is a fragmentary sectional view similar to FIG. 3 of a modified form of the invention.

In accordance with the invention, a platform 60 is provided along the rear rail 16 base so that it extends generally horizontally and longitudinally for a portion of the length of the brake along the rear rail 20, that is, longitudinally and parallel to the hinge line. The platform 60 comprises a tubular bar that is U-shaped and has spaced arms 61 connected by cross-portion 62. The free end of each arm extends through longitudinally-spaced openings 63, 64 in the side walls 65, 66 rear rail. The arms 61 are telescopically received in the rear rail so that the platform can be stored by shifting the arms 61 so that they extend within the confines of the front and rear rails 20, 16. The platform 60 can be extended by pulling outwardly as shown in FIG. 3. Locking pins 67 are provided for engaging openings 68, 69 in the arms 61 to provide for holding the platform in, extended or retracted. In the form shown in FIG. 4, a pin 70 is threaded into the opening 69 to limit the outward movement of the platform.

It can be seen that the platform thus provides support for work pieces and the like in close proximity to the worker but does not obstruct the top of the sheet bending brake or the movement of the handle of the sheet bending brake.

I claim:

1. A combined sheet bending brake and platform comprising a base, first and second bending members hinged to one another and mounted on the base, an anvil member attached to the first bending member for clamping a workpiece of sheet material on said first member such that moving the second member relative to the first member will bend the sheet material, said first and second bending members and anvil member extending longitudinally and horizontally, the longitudinal extend of the members constituting the length of the sheet bending brake with said hinge axis extending parallel to said sheet bending brake length, and a platform for workpieces and the like extending longitudinally for at least a portion of the length of the sheet bending brake along the base generally parallel and opposite to the hinge axis of the two members such that the area overlying the brake is generally unobstructed, said platform being movable horizontally between an extended position extending rearwardly of the brake away from the hinge axis and a position toward the hinge axis within the confines of the brake, the movement of said platform being movable in a direction transverse to the longitudinal extent of the platform.

2. The combined sheet bending brake set forth in claim 1 wherein said platform comprises a tubular bar which is generally U-shaped and includes spaced legs and a cross-portion, the spaced legs telescoping through openings in the base extending transversely of the hinge axis.

3. The combined sheet bending brake and platform set forth in claim 2 wherein means are provided for locking the platform in extended or retracted position.

4. The sheet bending brake platform set forth in claim 3 wherein said last mentioned means comprises spaced openings in each leg and lock pins insertable in selected openings to hold the platform in extended or retracted position.

5. The combined sheet bending brake and platform set forth in claim 1 wherein said brake comprises a plurality of generally C-shaped frame members, each said frame member including a long lower arm and a short upper arm overlying the lower arm, said base including a rear rail on said frame members and fastened thereto, said first member defining a clamping surface extending longitudinally, and being mounted on said lower arm, a bar individual to each said frame member and having its rear end pivoted to said frame member adjacent the rear of said upper arm, said anvil mamber extending longitudinally of said sheet bending brake and fixed to said bars, means for moving said anvil member into and out of clamping position, said platform being telescopically mounted on said rear rail for movement transversely and horizontally between an extended position extending rearwardly of the brake and away from the hinge axis and a position toward the hinge axis within the confines of the brake.

6. The combined sheet bending brake set forth in claim 5 wherein said platform comprises a tubular bar which is generally U-shaped and includes spaced legs and a cross-portion, the spaced legs telescoping through transverse openings in the rear rail.

7. The combined sheet bending brake and platform set forth in claim 6 wherein means are provided for locking the platform in extended or retracted position.

8. The sheet bending brake platform set forth in claim 7 wherein said last mentioned means comprises spaced openings in each leg and lock pins insertable in selected openings to hold the platform in extended or retracted position.

9. The sheet bending brake set forth in claim 1 wherein said platform comprises spaced legs telescoped through transverse openings in said base.

10. The sheer bending brake set forth in claim 9 wherein means are provided for locking the legs in extended or retracted position.

11. The sheet bending brake set forth in claim 10 wherein said last-mentioned means comprises spaced openings in each leg and lock pins insertable in selected openings to hold the platform in extended or retracted position.

12. The sheet bending brake set forth in claim 5 wherein said platform comprises spaced legs telescoped through openings in said base.

13. The sheet bending brake set forth in claim 12 wherein means are provided for locking the legs in extended or retracted position.

14. The sheet bending brake set forth in claim 13 wherein said last-mentioned means comprises spaced openings in each leg and lock pins insertable in selected openings to hold the platform in extended or retracted position.

* * * * *